United States Patent [19]

Guddas

[11] Patent Number: 4,733,499

[45] Date of Patent: Mar. 29, 1988

[54] DEVICE FOR LOCATING THE PANELS OF SLIDING DOORS AND THE LIKE IN SELECTED POSITIONS

[76] Inventor: Jürgen Guddas, Krumhörnweg 17, D-2800 Bremen 66, Fed. Rep. of Germany

[21] Appl. No.: 20,098

[22] Filed: Feb. 27, 1987

[30] Foreign Application Priority Data

Feb. 28, 1986 [DE] Fed. Rep. of Germany ..... 3606501

[51] Int. Cl.[4] ..... E05D 15/06

[52] U.S. Cl. ..... 49/404; 49/425; 49/450; 16/102

[58] Field of Search ..... 49/404, 425, 450, 451; 16/102 X, 89

[56] References Cited

U.S. PATENT DOCUMENTS

| | | | |
|---|---|---|---|
| 2,786,240 | 3/1957 | Tobiasz | 49/425 |
| 3,583,101 | 6/1971 | Pudenz | 49/425 X |
| 3,622,190 | 11/1971 | Mohun | 49/450 X |
| 3,640,559 | 2/1972 | Royer | 49/404 X |

FOREIGN PATENT DOCUMENTS

| | | | |
|---|---|---|---|
| 408697 | 9/1966 | Switzerland | 49/425 |

*Primary Examiner*—Philip C. Kannan
*Attorney, Agent, or Firm*—Peter K. Kontler

[57] ABSTRACT

The track for the panel of a sliding door or window confines a locating device with two resilient leaves which have first end portions secured to the bottom part of the track and second end portions normally extending upwardly into the path of movement of the rim of a wheel at the underside of the panel. The second end portions of the leaves are disposed between the first end portions and define a gap wherein the lowermost portion of the rim comes to rest after the rim has been caused to roll over one of the leaves and to be arrested by the upwardly extending second end portion of the other leaf. If the panel is to be shifted to a different position, it is pushed with a force which suffices to enable the rim of the wheel to depress the second end portion of one of the leaves whereupon the rim rolls over the one leaf toward a different position. A foot can be clamped to the track to positively prevent the panel from moving beyond a selected position.

12 Claims, 7 Drawing Figures

DEVICE FOR LOCATING THE PANELS OF SLIDING DOORS AND THE LIKE IN SELECTED POSITIONS

BACKGROUND OF THE INVENTION

The invention relates to improvements in sliding doors, windows and like structures wherein one or more panels are movable in or on tracks and carry wheels, rollers or similar friction reducing rolling elements which roll along the paths defined by the respective tracks. Such panels (with or without light transmitting panes therein) are used in doors, windows, pieces of furniture and elsewhere. For the sake of simplicity, the following description will deal primarily with sliding doors; however, it will be appreciated that the invention can be embodied with equal advantage in many other structures including windows, cabinets and vehicles.

It is customary to provide sliding doors with locating devices which maintain the panel or panels in selected positions. The locating devices are not only desirable but actually necessary in many instances; for example, if the track in which the rolling elements on a panel are to roll is inclined so that, when the rolling elements are adequately lubricated, the panel will automatically move to a position in which it strikes an impediment, e.g., the frame or the end of the track. Heretofore known proposals include the provision of depressions which are machined into or otherwise formed in the track so as to define recesses or seats for portions of the rolling elements and to thus maintain the panel in a selected position until and unless the operator decides to shift the panel to a different position by exerting a force which suffices to expel the rolling element from its recess. The force which is required to expel a rolling element from its recess is or can be quite substantial so that these solutions are not satisfactory when the door is to be shifted by a senior citizen, by a child, by an infirm person or by a convalescent.

OBJECTS AND SUMMARY OF THE INVENTION

An object of the invention is to provide a sliding door or a like structure wherein the panel or panels can be releasably located in one or more selected positions in a novel and improved way so that the shifting of the panel or panels from selected positions requires the exercise of a relatively small effort.

Another object of the invention is to provide a sliding door or the like wherein the means for releasably locating the panel or panels in one or more selected positions is simple, compact, inexpensive and can be readily installed in or on existing tracks for the panels.

A further object of the invention is to provide panel locating means which can be installed in or on existing sliding doors, windows or the like to enable an operator to arrest and retain the panel or panels in one or more selected positions.

An additional object of the invention is to provide panel locating means which can be installed in existing sliding doors or the like with a minimum of work and in such a way that the locating means can be readily removed if and when necessary, for example, to allow for removal of the panel or panels from their respective tracks.

Still another object of the invention is to provide a novel and improved combination of means for releasably and fixedly locating one or more sliding panels in one or more selected positions.

A further object of the invention is to provide locating means which are constructed, assembled and mounted in such a way that they offer the desired resistance to movement of a panel beyond a preselected position and which are effective irrespective of the direction in which the panel is pushed or pulled to the preselected position.

An additional object of the invention is to provide a locating device which can be mass-produced at a minimal cost and can be replaced with a minimum of effort, if and when the need arises, without requiring the utilization of specially designed tools so that it can be installed or removed by home owners, tinkers and other persons without a technical background.

The invention is embodied in a sliding door or window which comprises a track defining an elongated path, a panel, a wheel or another rolling element which is rotatably mounted on the panel and can have a rim which rolls in the track along the path, and means for releasably locating the rolling element in a selected position with reference to the track. The locating means comprises at least one yieldable arm (e.g., a flat resilient metallic strip which constitutes a leaf spring) which is installed in the track so that the rolling element can ride over it. The arm has a locating portion (preferably an end portion of the arm) which normally extends into the path to abut against the oncoming rolling element and to thereby yieldably hold the rolling element in the position in which the latter abuts the locating portion. A second portion of the arm is adjacent the path so that the rolling element depresses the arm when the rolling element approaches and rides over the arm in a direction toward the second portion. The rolling element first abuts the end portion of the arm when it approaches the arm from the opposite direction.

The track can include a rail having an elongated web or base and at least one sidewall which is adjacent the web. The second portion of the arm is then adjacent the web while the end portion of the arm normally extends from the web and into the path.

In accordance with a presently preferred embodiment, the locating means further comprises a second arm (such as an elongated leaf of resilient metallic strip material) and a connector between the arms. The second portions of the arms are rigid with the connector and the end portions of the arms are normally spaced apart from the connector and are invariably spaced apart from each other to define a gap. Such design of the locating means ensures that a portion of the rolling element can be located between the end portions of the arms regardless of the direction in which the rolling element is rolled to the position between the end portions. As a rule, or in many instances, the track will constitute a C-shaped rail having a web or base and two elongated sidewalls which flank the web and the path for the rolling element.

The sliding door or window of the invention can further comprise blocking means installed in a predetermined portion of the track to positively prevent the rolling element from rolling beyond such predetermined portion of the track. The blocking means can comprise a substantially hammerhead-shaped foot in the path and means (e.g., a screw or a bolt) for clamping the foot to the track.

The track can be provided with one or more abutments to hold the locating means in a selected position.

The abutment or abutments can constitute integral projections (e.g., lugs) of the track.

The arrangement is preferably such that each arm of the locating means normally makes with the web of the track a small acute angle so that the arm can be readily depressed against the connector and/or against the web when the rolling element rides thereover. This applies regardless of whether the rolling element rolls first over the end portion of the arm or first over the second portion.

The novel features which are considered as characteristic of the invention are set forth in particular in the appended claims. The improved sliding door or window itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
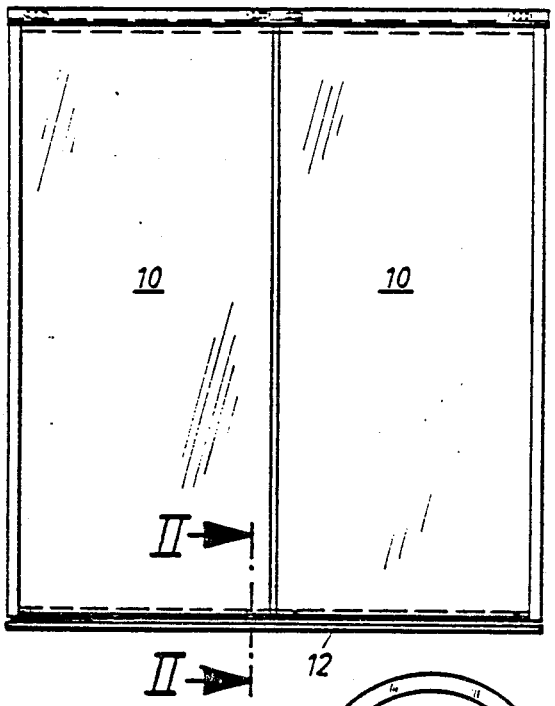
FIG. 1 is a schematic front elevational view of a sliding door with two panels and with tracks for the elements on the panels.
Figure 2:
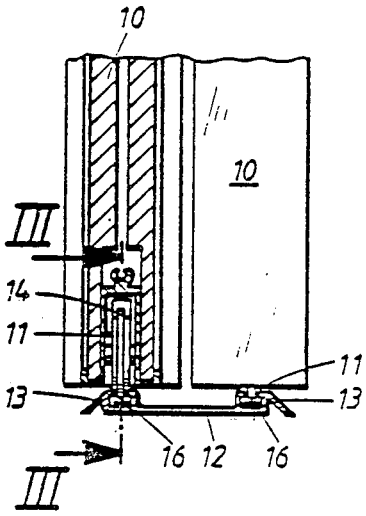
FIG. 2 is an enlarged fragmentary transverse vertical sectional view as seen in the direction of arrows from the line II—II of FIG. 1, showing one form of the improved means for releasably locating a panel in selected position.

Referring first to FIGS. 1 and 2, there is shown a sliding door with two panels 10 which are disposed in parallel vertical planes and the lower portions of which carry rolling elements 11 in the form of rollers or wheels (only one shown in FIG. 2) which roll along elongated paths defined by a composite track 12 including a first section or rail 13 for the wheels 11 of one of the panels and a second section or rail 13 for the wheels 11 of the other panel. A wheel 11 is or can be mounted at both ends of the lower portion of each panel 10. The exact manner in which the wheels 11 are mounted in suitably configurated recesses machined into or otherwise formed in the lower edge faces of the panels 10 forms no part of the invention; each such wheel is rotatable about a horizontal axis and has a circumferential rim or tread 14 which rolls along the respective section of the composite track 12 when a person decides to shift the respective panel 10 in a direction at right angles to the plane of FIG. 2. The illustrated composite track 12 can be replaced with two discrete sections 13 each in the form of a substantially C-shaped rail having a bottom portion or web 21 and two upstanding sidewalls or flanges 121 which flank the web and the elongated path which is defined by the respective rail for the lowermost portions of wheels 11 on the corresponding panels 10. The rims 14 of the wheels 11 extend into the spaces 15 between the web 21 and sidewalls 121 of the respective section or rail 13 so that they are confined to travel along a predetermined elongated path.

Figure 5:
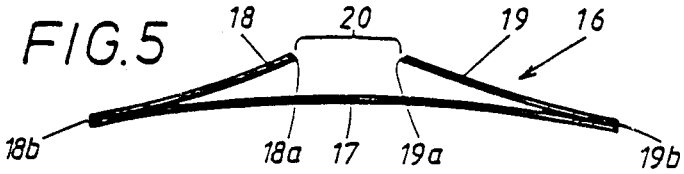
FIG. 5 is an elevational view of the locating means for use in the sliding door of FIG. 1.

In accordance with a feature of the invention, the sliding door is further provided with one or more locating devices 16 which are designed to releasably hold the panels 10 in selected positions. One locating device 16 is shown in FIG. 5; it comprises an elongated connector 17 which can be riveted, bolted, screwed or otherwise permanently or separably affixed to the web 21 of the respective section or rail 13 in the corresponding space 15 and whose end portions are rigidly connected to or integral with the respective end portions 18*b*, 19*b* of two elongated arms in the form of leaves 18, 19 which can be made of a flexible elastic material, e.g., spring steel and whose other end portions 18*a*, 19*a* exhibit a tendency to move away from the intermediate portion of the connector 17. The free end portions 18*a*, 19*a* of the leaves 18, 19 define a gap 20 of preselected width; the widths of this gap (plus the elasticity of the leaves 18, 19) will determine the magnitude of the force which is necessary to shift a panel 10 from the position in which the lowermost portion of the rim 14 of one of its wheels 11 contacts the upper side of the connector 17 between the two leaves. The leaves 18 and 19 can yield so that the wheels 11 on the respective panels 10 can ride thereover if the person pushing or pulling a panel 10 does not wish to move the panel to that position which is determined by the location of the gap 20 between the leaves 18 and 19. The bias of the leaves 18 and 19 can suffice to maintain the wheel 11 in a selected position (see FIG. 3).

Figure 3:
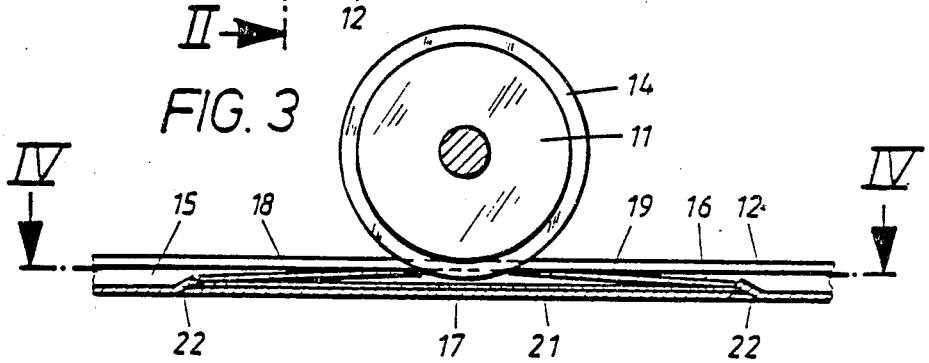
FIG. 3 is an enlarged vertical sectional view as seen in the direction of arrows from the line III—III of FIG. 2.
Figure 4:
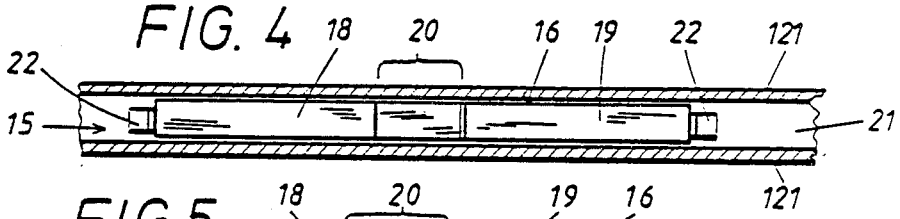
FIG. 4 is a horizontal sectional view as seen in the direction of arrows from the line IV—IV of FIG. 3, with the rolling element omitted.

FIGS. 3 and 4 illustrate one mode of separably or more or less permanently securing a locating device 16 to the respective rail 13. Thus, the web 21 of the rail 13 has two spaced-apart integral abutments in the form of lugs 22 which are bent upwardly from the general plane of the web 21 and can engage those end portions (18*b*, 19*b*) of the leaves 18 and 19 which are remote from the gap 20.

Once the locating device 16 is properly installed in a manner as shown in FIGS. 3 and 4, it can releasably locate the respective panel 10 in the selected position (at the locus of the gap 20) regardless of whether the wheel 11 is caused to roll first over the leaf 18 or over the leaf 19. For example, if the wheel 11 arrives in a direction from the left to the right, as seen in FIG. 3, its rim 14 first rides over the leaf 18 and thereupon abuts the upwardly extending free end portion 19*a* of the leaf 19 to be thereby arrested in a preselected position in which the deepmost portion of the rim 14 is located in the gap 20 and the free end portion 18*a* of the leaf 18 can rise to engage the rim 14 at a level above the connector 17. This ensures that the wheel 11 is releasably held against any rolling movement in either direction. If a person decides to move the panel 10 to a different position, the panel is pushed or pulled with a relatively small force which suffices to cause the rim 14 to ride over the free end portion 18*a* or 19*a* of the leaf 18 or 19 and thereupon to the newly selected position where the panel can be held by a second locating device or as a result of abutment against a vertical frame member of the sliding door. Each of the two sections or rails 13 can carry one, two or more locating devices 16. As a rule, the weight of a panel 10 and of the wheels 11 which are mounted thereon suffices to ensure that the leaf 18 or 19 over which a wheel 11 rides is fully depressed (flattened) so that the path for the wheels is not bumpy and the panel will not rise and fall appreciably while one of its wheels rides over a locating device 16.

If desired, the entire locating device 16 can be made of a single piece of suitable metallic or plastic material. For example, a length of metallic strip stock can be bent to form the connector 17 and the two leaves 18, 19. Alternatively, the connector 17 can be made of a first material and the leaves 18, 19 can be made of a second material which is sufficiently elastic and the end portions 18*b*, 19*b* of such leaves are then adhesively secured, spot welded, riveted, clamped or otherwise permanently or separably affixed to the respective end portions of the separately produced connector 17. The length of one of the leaves 18, 19 may but need not necessarily match the length of the other leaf, and each of the two leaves can be provided with a discrete connector which is secured to the corresponding rail 13. Thus, the connector 17 of FIG. 5 can be replaced with two discrete connectors one of which is integral with the leaf 18 and the other of which is integral with the leaf 19.

As a rule, or at least in many instances, the resistance of the leaves 18, 19 to depression by the rim 14 of a wheel 11 will be less (or considerably less) than the resistance of a wheel to leaving a depression in the rail therebelow. This ensures that the panels 10 can be shifted with the exertion of a relatively small force in spite of the fact that two relatively weak elastic leaves 18, 19 will suffice to ensure the retention of the corresponding panel 10 in a desired position. This holds true even if the rails 13 are inclined so that the wheels 11 exhibit a tendency to roll downhill.

The improved locating device 16 is practically fully concealed in the space 15 between the sidewalls 121 of the respective rail 13 so that it does not detract from the appearance of the sliding door. The bias of the leaves 18, 19 may but need not be identical. Thus, the manufacturer can intentionally produce locating devices each of which has a weaker leaf and a stronger leaf so that a greater force is required to deform one of the leaves and a lesser force is to be applied in order to deform the other leaf.

It has been found that the locating device 16 will normally remain in a selected position even if its connector is not positively secured to the respective rail 13. Thus, friction between the connector 17 and the rail 13 can suffice to maintain the entire locating device 16 in the desired position. Friction between the connector 17 and the web 21 of the rail 13 increases still further when a wheel 11 rides over one of the leaves 18, 19 because the leaves act not unlike leaf springs and bias the connector 17 against the web 21. The aforementioned abutments 22 can constitute simple lugs which are bent out of the general plane of the web 21 to merely extend upwardly so as to constitute stops which prevent longitudinal shifting of the locating device 16 or to overlie the adjacent end portions 18*b*, 19*b* of the respective leaves. The abutments 22 can be replaced with screws, bolts, studs, rivets or any other suitable means capable of holding the locating device 16 in a selected position between the sidewalls 121 of the corresponding rail 13.

If it is desired to provide the sliding door with means for invariably stopping the panel or panels 10 in one or more selected positions, the improved locating device or a modified locating device can be used with suitable blocking means which is or are installed in the respective section or rail 13 of the track 12. This can be seen in FIGS. 6 and 7 which show a modified locating device 16 with a single resilient arm or leaf 18 and a blocking device in the form of a shoe 23 which is separably but fixedly secured to the rail 13. The shoe 23 has a hammerhead-shaped member or foot 24 which is inserted into the space 15 between the sidewalls of the rail 13 and is clamped to the rail by a threaded bolt 25 which urges it against the web 21. The properly installed foot 24 constitutes an obstacle which is sufficiently high to ensure that a wheel 11 cannot ride thereover, i.e., the rim 14 can be moved into abutment with the foot 24 but cannot advance beyond it. If desired, a single blocking device 23 can be installed in a rail 13 between the two wheels 11 at the underside of a panel 10 so that such single blocking device can arrest the panel in two different positions, depending upon which of the two wheels 11 has been rolled into abutment with the foot 24.

Figure 6:
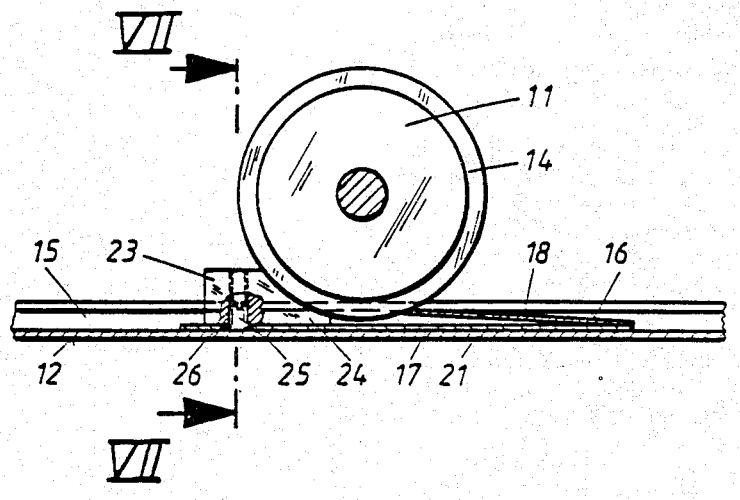
FIG. 6 is a sectional view similar to that of FIG. 3 but showing modified locating means and means for positively blocking the movement of a panel beyond a selected portion of its track.
Figure 7:
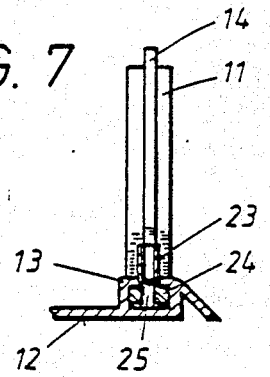
FIG. 7 is a sectional view as seen in the direction of arrows from the line VII—VII of FIG. 6.

The blocking device 23 can be used independently of or in conjunction with one or more locating devices which embody the invention. FIGS. 6 and 7 show a locating device 16 with a single leaf 18 which is adjacent the blocking device 23 so that a gap (corresponding to the gap 20 shown in FIG. 4 or 5) is defined by the free end portion of the single leaf 18 and the foot 24. Once the wheel 11 has been caused to assume the position which is shown in FIG. 6, the free end portion of the leaf 18 is free to rise above and away from the connector 17 (which is permanently or separably affixed to the web 21 of the rail 13) so that the rim 14 of the wheel 11 is flanked by the leaf 18 and by the foot 24. While the wheel 11 can overcome the resistance of and depress the leaf 18 (in order to be rolled in a direction to the right, as seen in FIG. 6), the panel which carries the wheel 11 of FIG. 6 cannot be advanced to the left beyond the position corresponding to that of the wheel 11. As shown, the arrangement may be such that the connector 17 which serves to secure the leaf 18 to the rail 13 extends beneath the foot 24 and has a suitably configurated opening 26 for the clamping means 25.

The rails 13, the wheels 10 and the blocking and locating devices can be made of a metallic or plastic material. The wheels 11 can be replaced or used jointly with other types of rolling elements.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a sliding door or window, the combination of a track defining an elongated path; a panel; a rolling element rotatably mounted on the panel and arranged to roll in said track along said path; and means for releasably locating the rolling element in a selected position with reference to said track, including at least one yieldable arm installed in said track so that the rolling element can ride thereover, said arm having a locating portion normally extending into said path to abut against the oncoming rolling element and to thereby yieldably hold the rolling element in the position in which the rolling element abuts said locating portion.

2. The combination of claim 1, wherein said arm is elongated and said locating portion constitutes an end portion of the arm, said arm further having a second portion which is adjacent said path so that the rolling element depresses the arm when it approaches and rides over the arm in a direction toward said second portion and the rolling element immediately abuts said end portion when it approaches the arm from the opposite direction.

3. The combination of claim 2, wherein said track includes a rail having an elongated web and at least one sidewall adjacent said web, said second portion being adjacent said web and said end portion normally extending from said web and into said path.

4. The combination of claim 3, wherein said arm is resilient.

5. The combination of claim 3, wherein said arm is a leaf spring.

6. The combination of claim 2, wherein said locating means further comprises a second arm and a connector between said arms, the second portions of said arms being rigid with said connector and the end portions of said arms being normally spaced apart from said connector and being spaced apart from each other so that a portion of the rolling element can be located between said end portions regardless of the direction in which the rolling element is rolled to the position between said end portions.

7. The combination of claim 6, wherein said track includes a C-shaped rail having a web and two sidewalls flanking said web and said path.

8. The combination of claim 1, further comprising blocking means installed in a predetermined portion of said track to positively prevent the rolling element from rolling beyond said predetermined portion.

9. The combination of claim 8, wherein said blocking means comprises a substantially hammerhead-shaped foot in said path and means for clamping said foot to said track.

10. The combination of claim 1, further comprising at least one abutment provided on said track to hold said arm in a predetermined portion of said track.

11. The combination of claim 10, wherein said abutment is an integral projection of said track.

12. The combination of claim 1, wherein said track has an elongated web adjacent one side of said path and said arm normally makes an acute angle with said web.

* * * * *